US007735272B2

(12) United States Patent
Caroussos

(10) Patent No.: US 7,735,272 B2
(45) Date of Patent: Jun. 15, 2010

(54) STRENGTHENED ASSEMBLY ENCLOSED IN CONSTRUCTION

(76) Inventor: Apostolos Caroussos, 2057 rue du Parc Gomin, Quebec, QC (CA) G1T 1A6

( * ) Notice: Subject to any disclaimer, the term of this patent is extended or adjusted under 35 U.S.C. 154(b) by 233 days.

(21) Appl. No.: 12/080,754

(22) Filed: Apr. 3, 2008

(65) Prior Publication Data

US 2008/0289273 A1 Nov. 27, 2008

(30) Foreign Application Priority Data

Apr. 3, 2007 (CA) ..... 2584561

(51) Int. Cl.
*E04B 1/10* (2006.01)
*E04C 5/08* (2006.01)

(52) U.S. Cl. ..... 52/233; 52/223.7; 52/223.13

(58) Field of Classification Search ..... 52/23, 52/233, 223.7, 223.9, 223.14, 223.13
See application file for complete search history.

(56) References Cited

U.S. PATENT DOCUMENTS 3,927,494 A * 12/1975 Struben ..... 52/23
3,943,670 A * 3/1976 Miller ..... 52/23
4,068,426 A * 1/1978 Warren ..... 52/149
4,472,916 A * 9/1984 Krebs ..... 52/236.6
4,599,837 A * 7/1986 Wrightman ..... 52/233
4,812,096 A * 3/1989 Peterson ..... 411/231
4,823,528 A * 4/1989 Faw ..... 52/233
4,887,691 A * 12/1989 Rotondo ..... 181/210
4,909,012 A * 3/1990 Thompson et al. ..... 52/745.21
5,535,561 A * 7/1996 Schuyler ..... 52/223.13
5,881,499 A * 3/1999 Luzzi ..... 52/23
6,722,085 B2 * 4/2004 Pittman ..... 52/23
6,843,027 B2 * 1/2005 Gaddie et al. ..... 52/92.1
6,904,728 B2 * 6/2005 Stutts ..... 52/233
7,117,647 B2 * 10/2006 Clarke ..... 52/233
7,594,370 B2 * 9/2009 Clarke ..... 52/586.1
2001/0037611 A1 * 11/2001 Cornett, Sr. ..... 52/23
2006/0248825 A1 * 11/2006 Garringer ..... 52/233
2009/0133345 A1 * 5/2009 Wrightman ..... 52/233

* cited by examiner

*Primary Examiner*—Brian E Glessner

(57) ABSTRACT

A system of construction using a mechanical device (20) which applies a force to an assembly of elements having a high resistance in compression in order to build walls, roofs, floors, and beams. The device makes it possible to preserve the integrity of the assembly even when undergoing changes in volumetry. It comprises three parts: a first component, namely a winch (24) applies a force to the assembly at one of its ends. A second component, a thin steel band (22) transmits the force to the assembly over a long distance. A third component, a spring (30) in compression maintains the force applied by the first two components even when there is a change in volumetry. A compressible and impermeable membrane (49) ensures the sealing of the assembly and metal fasteners ensure the stability of the assembly, sideways.

7 Claims, 7 Drawing Sheets

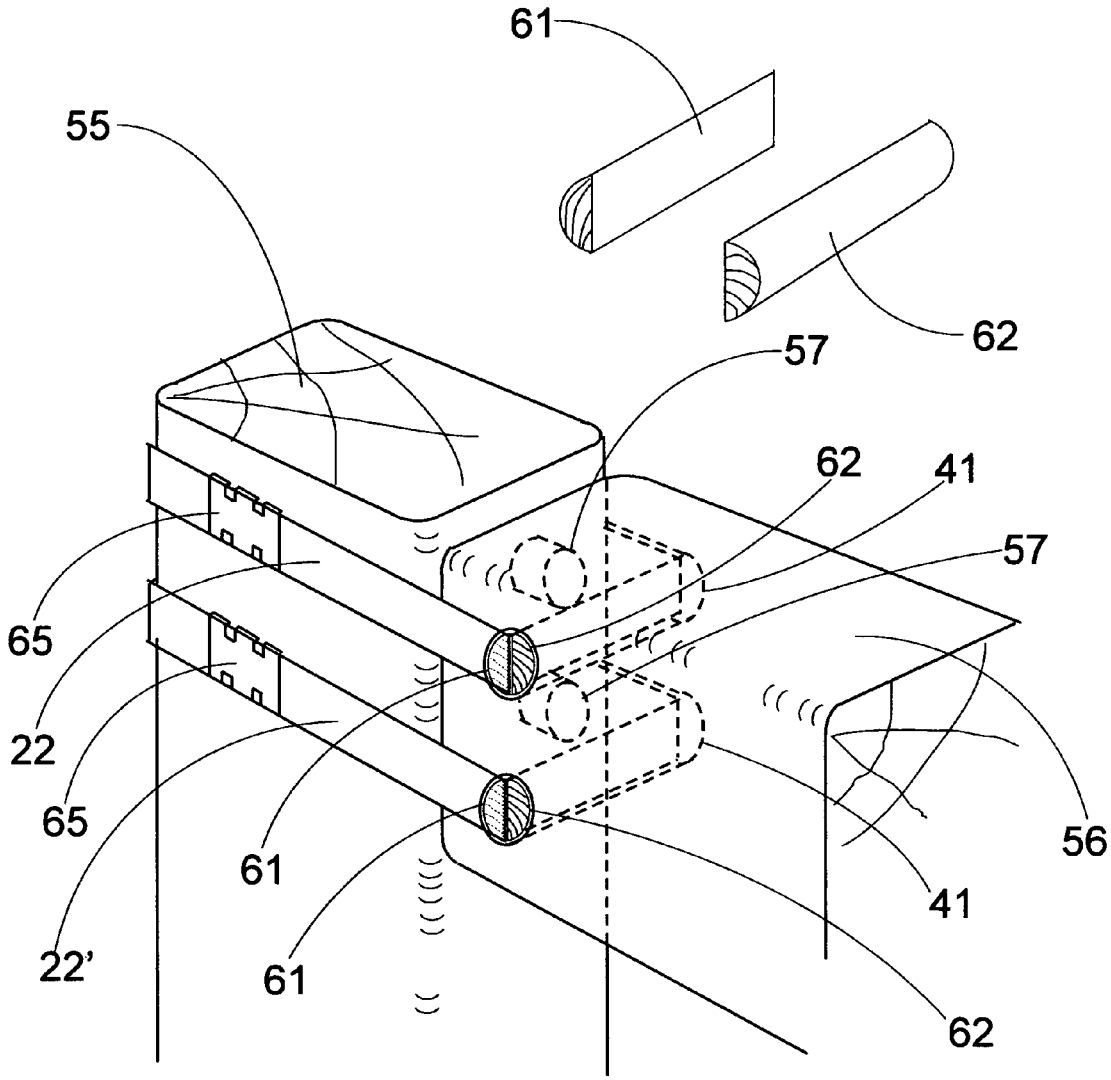
FIG 3.1

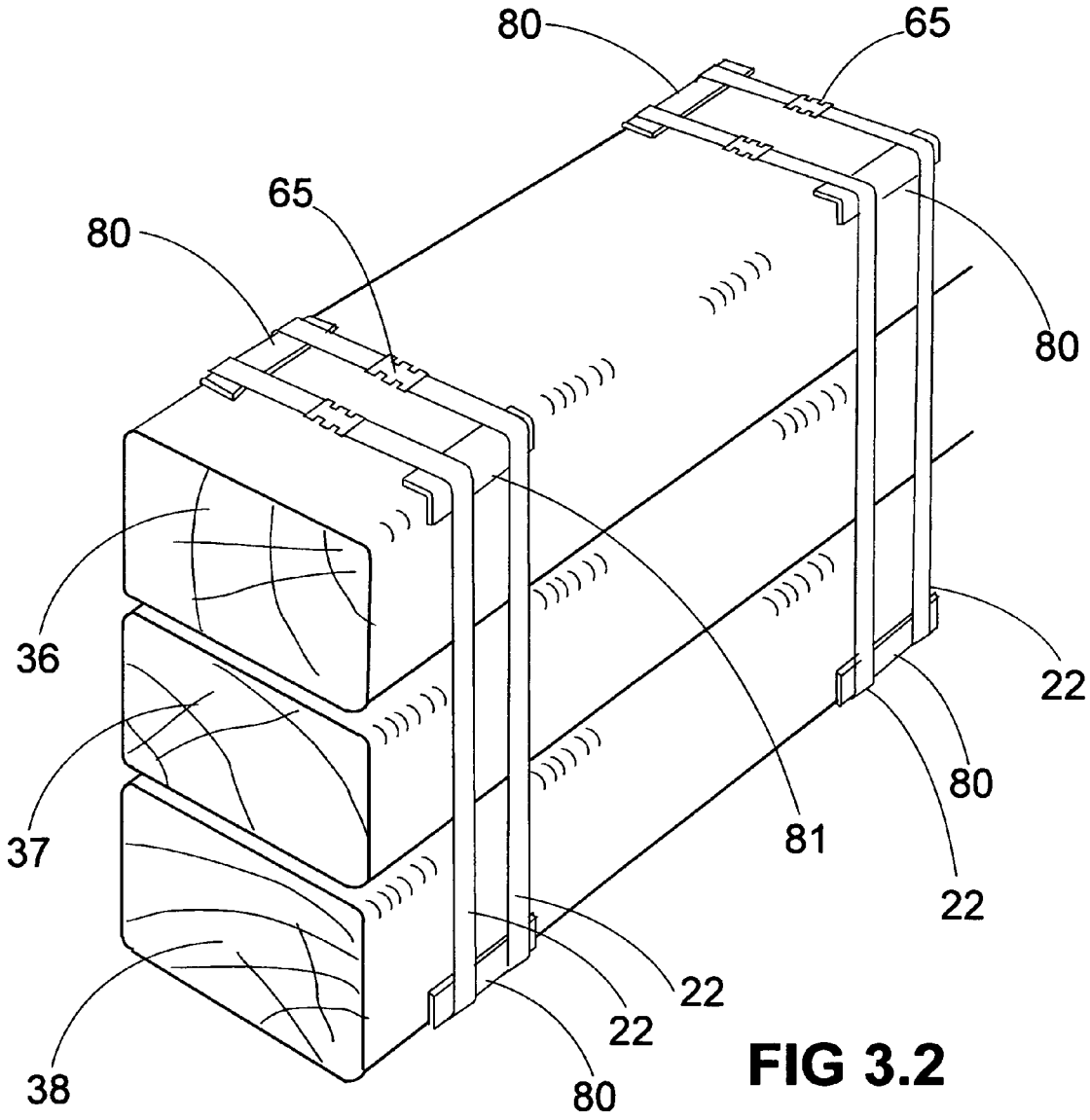
FIG 3.2

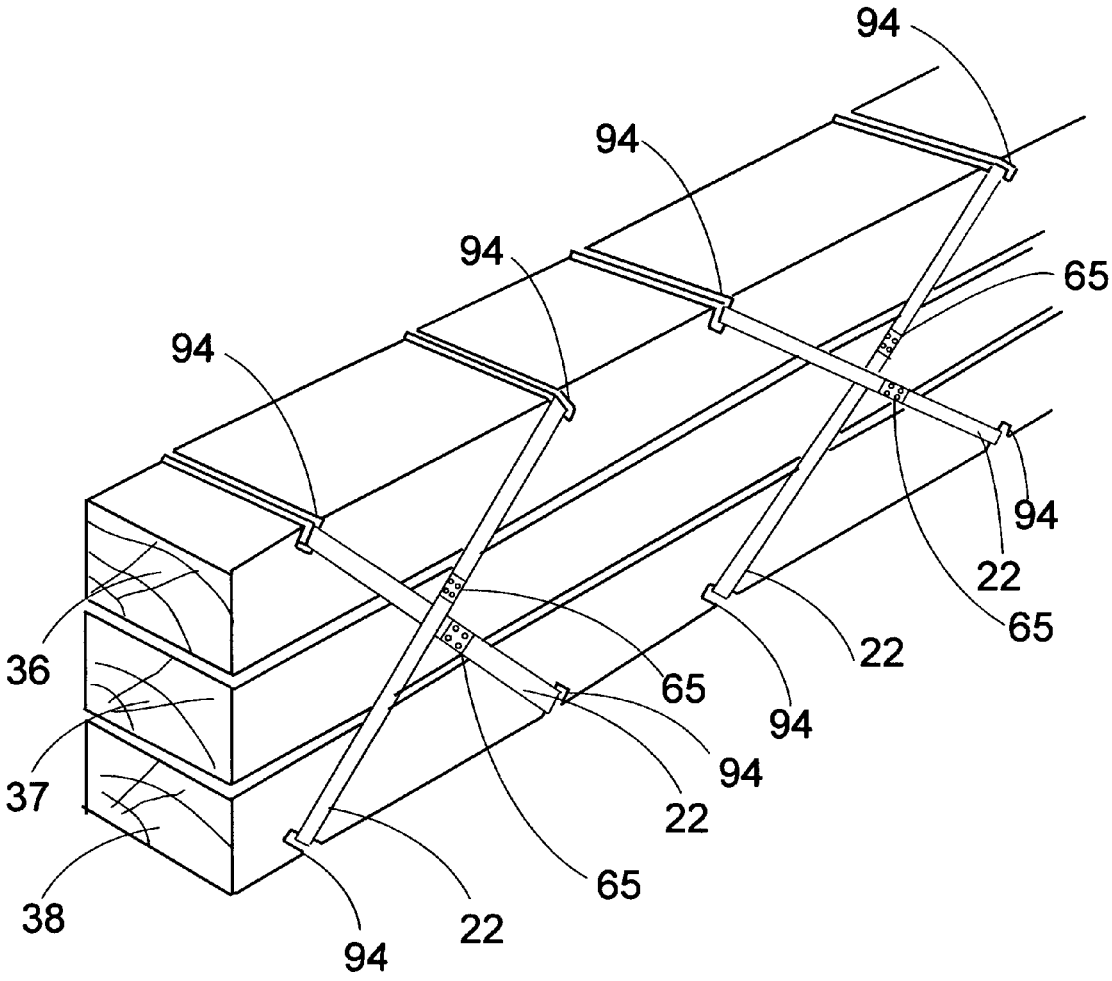
FIG 3.3

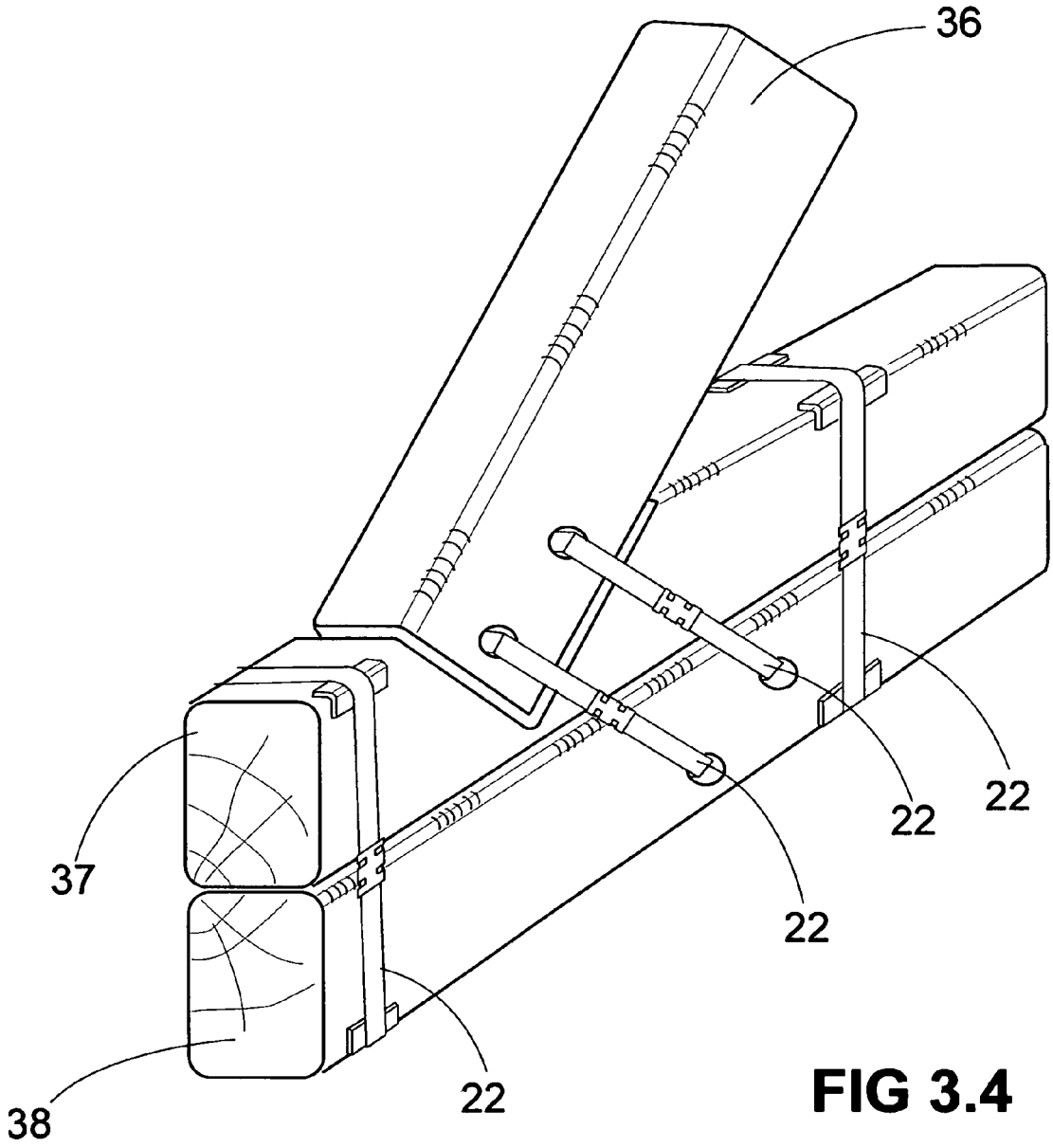
FIG 3.4

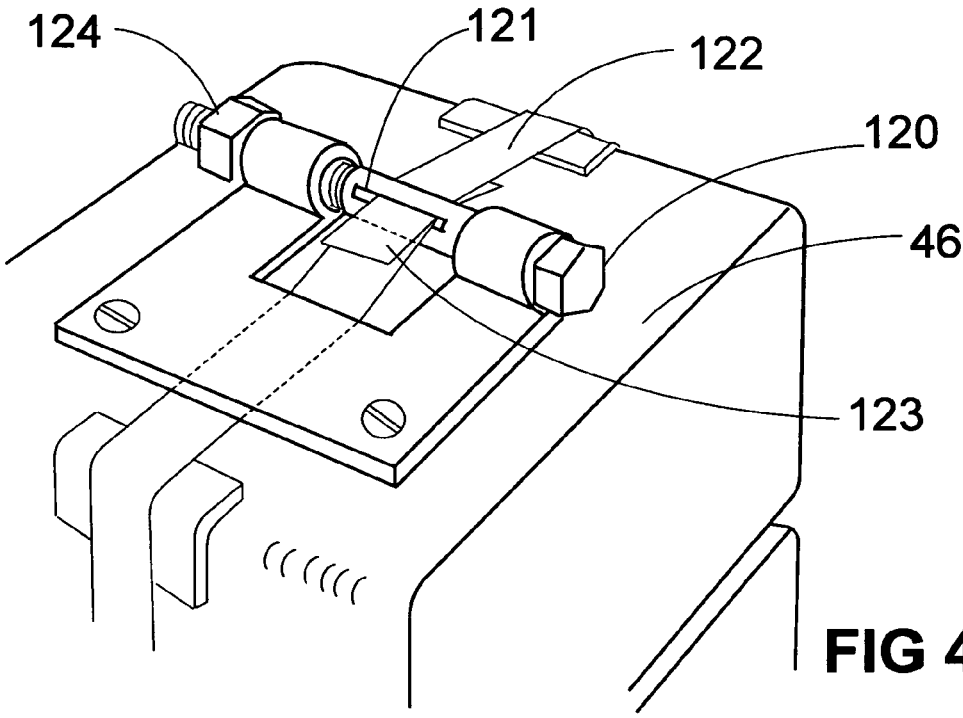
FIG 4.1
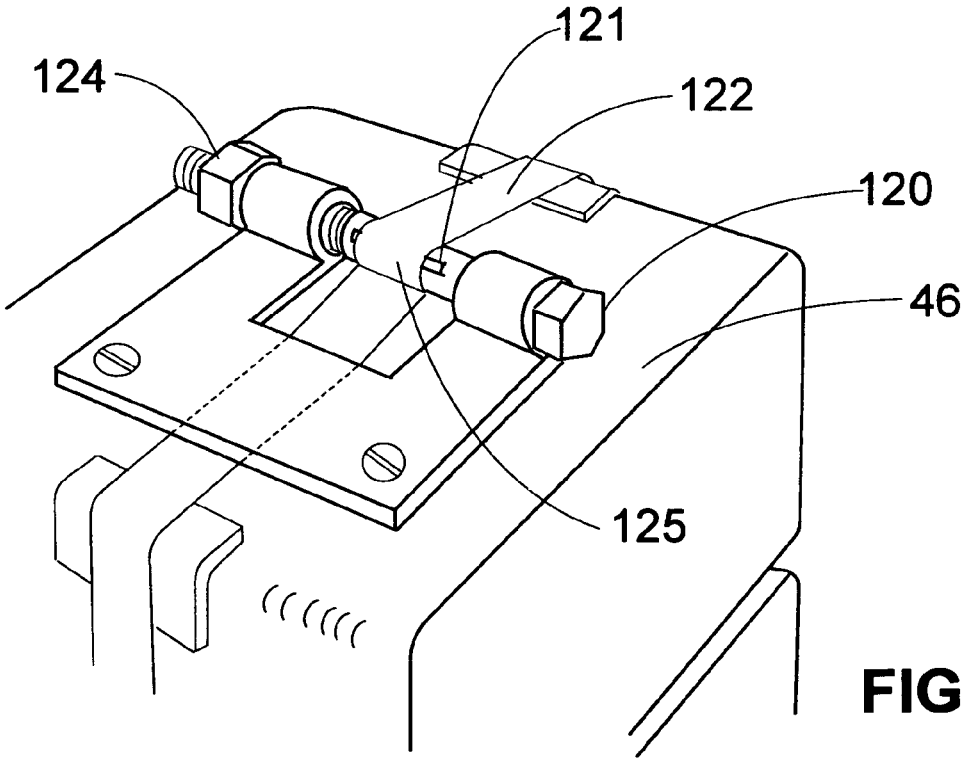
FIG 4.2

STRENGTHENED ASSEMBLY ENCLOSED IN CONSTRUCTION

BACKGROUND OF THE INVENTION

The present invention relates to a system of construction which uses a mechanical device for maintaining fast an assembly of structural components. This device maintains together, in compression, elements which form walls, roofs, floors, beams, etc.

PRIOR ART

This application refers to a priority Canadian application of the same inventor CA 2,584,561.

A search in the prior art revealed some systems that caught our attention:

U.S. Pat. No. 5,535,561 "CABLE HOLD DOWN AND BRACING SYSTEM" Schuyler Peter W. shows a method and apparatus for tying building components together. A cable 46 is used to tie lengthwise.

U.S. Pat. No. 6,626,621 "SELECTIVELY REMOVABLE TIE-DOWN STRAP WINCH ASSEMBLY FOR A TRAILER OR TRUCK" Hugg Richard C., shows a Y-shaped winch assembly for use with a trailer or truck. A wall structure (60,64,68) and a compression spring 80 is positioned above the ceiling. Means of adjustment (286) are available.

U.S. Pat. No. 6,904,728 H. Craig Stutts 14 Jun. 2005 shows a peg (58) along a screw (30) which compresses a spring which applies a pressure against a platform. The latter equally applies a pressure against beams to tighten them.

U.S. Pat. No. 7,117,647 Gregory A. Clarke, 10 Oct. 2006, shows an assembly of wooden beams fastened over a typical height of 8 inches.

FR 1,345,722 Pierre V. Pasquier, 30 Oct. 1962, an assembly of wood parts interlaced and related by wet joints.

SUMMARY OF THE INVENTION

The primary objective of this system of construction and its mechanical device of assembly is to make it possible to build rigid plans rapidly and to maintain the structural integrity of these. These rigid plans are used in the field of construction. Each assembly constructed with this mechanical device is capable of supporting important loads while being watertight. A specific objective is the construction of rigid plans by stacking structural components and by integrating a mechanical device within the components in order to transmit and maintain a force continuously and dynamically.

One of the objectives is to incorporate within a wall, tensioning elements which join an upper part with a lower part, a left side part with a right side part, by tensioning elements which are all hidden within the confines of that wall. To achieve this objective, a winch is enclosed in an opening in a top log. A thin steel band is wrapped about a reel; a hole is bored through the stacked logs to a bottom piece; at the bottom a compression spring is positioned to receive the pull from the extensible band. The present invention will be further understood from the following description with reference to the drawings.

BRIEF DESCRIPTION OF DRAWING FIGURES

FIGS. 3.1, 3.2, 3.3 and 3.4 are perspectives of several applications of assembly with bands.

FIGS. 4.1 and 4.2 are perspectives of a tensioner with bands.

DETAILED DESCRIPTION OF THE PREFERRED EMBODIMENTS

In the following description and in the accompanying drawings, the numeral numbers refer to identical parts in the various Figures.

Figure 1:
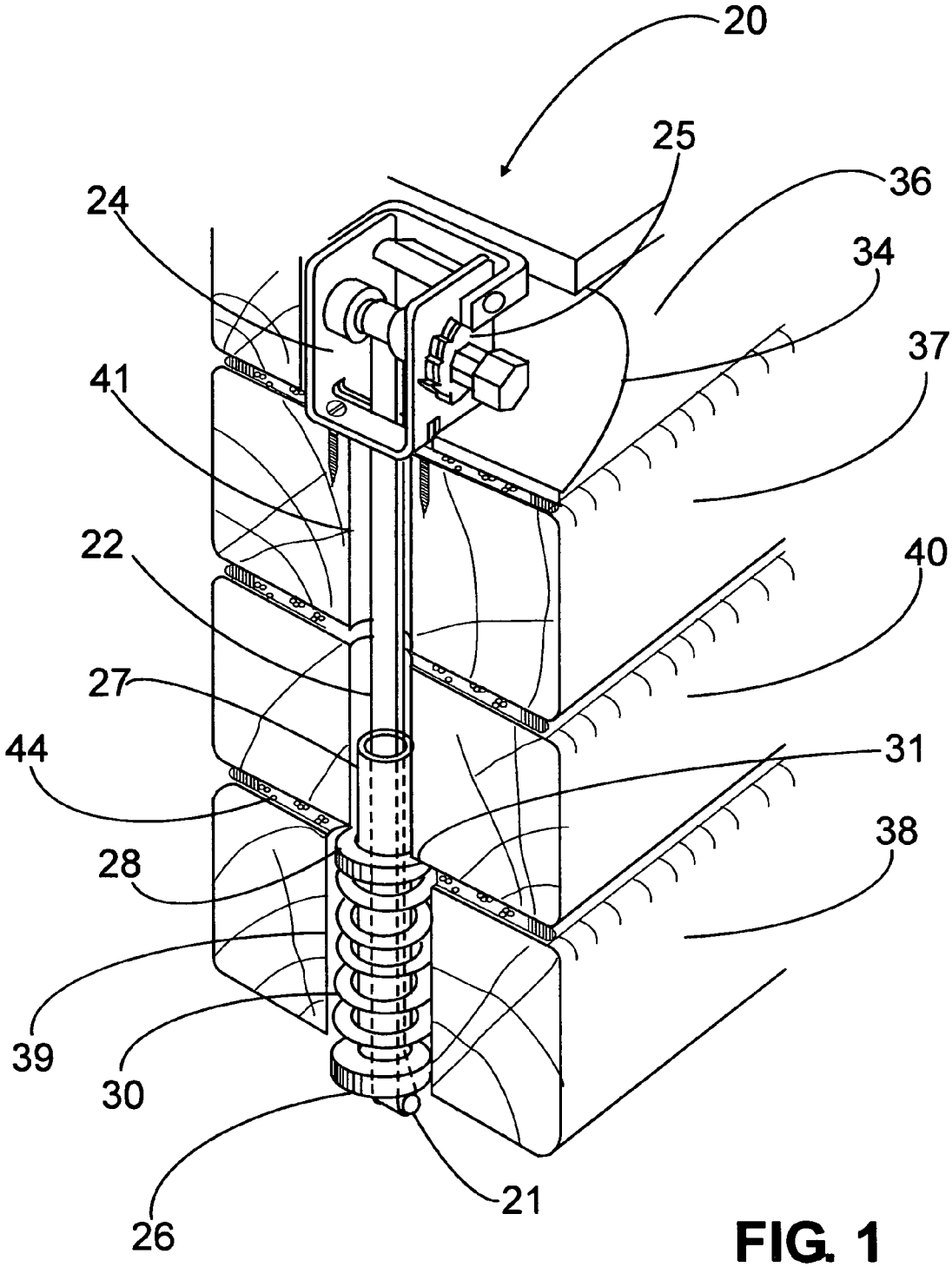
FIG. 1 is a perspective of the device placed in a cut wall.

FIG. 1 shows a device 20 which comprises a thin steel band 22 rolled around a winch 24 which crosses a spring 30 which is rolled around a steel stem 21. The steel stem 21 which is welded onto a steel disc 26 is raised by the thin steel band 22 under the action of the winch 24. The rising of the steel disc 26 makes possible the compression of the spring 30. A metal pipe 27 is welded onto plate 26 and slides into a second steel disc 28 during the compression of the spring. The metal pipe 27 stabilizes laterally the spring during the operation. The spring is also supported against the second steel disc 28. The second steel disc 28 is supported against an edge 31. In a higher beam 36, a hole 34 contains the winch giving access to a ratchet 25. Under the higher beam there is a second beam 37 which the winch 24 presses thereon. There is an intermediate beam 40 which comprises a first passage 41 for the thin steel band at the bottom of which there is the edge 31 which blocks the second steel disc 28. A lower beam 38 comprises a passage 39 of spring 30. The diameter of the passage 39 of spring 30 is greater than the diameter of the passage 41 of band 22, the difference being the edge 31. The thin steel band 22 is of rectangular shape and it may be made of metal, namely stainless steel, or be a circular cable made of steel, kevlar or other materials having the same characteristics. Water proof joints 44 are inserted between the beams.

Figure 2:
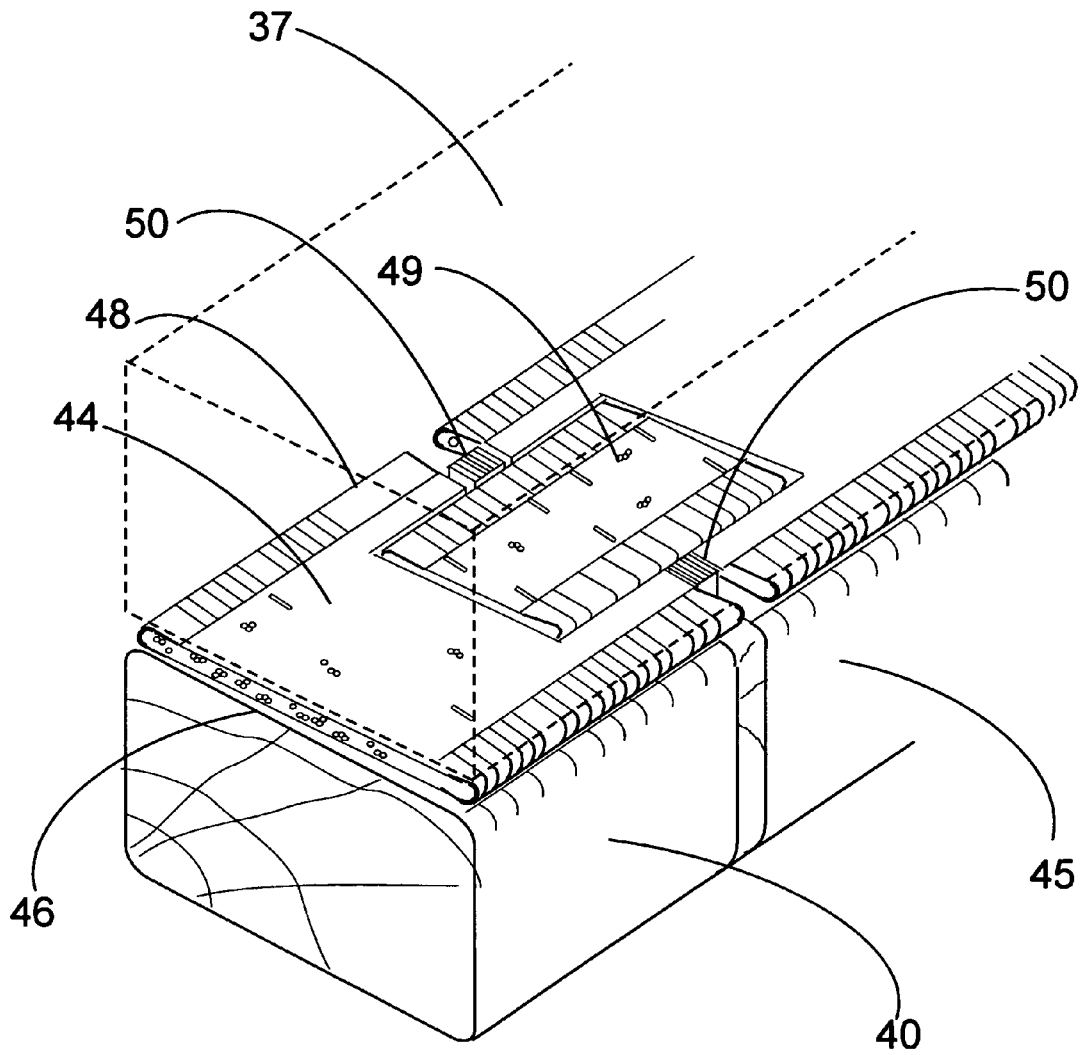
FIG. 2 is a perspective of a tight compressible seal.

FIG. 2 shows horizontal seals 44 and 49 made of foam and having a rubbery texture 48 at the ends, on a bearing surface 46 and it shows a vertical joint 50 made of foam, having a rubbery texture on the face exposed between adjoining beams 40 and 45. The pieces of foam seals 44 and 49 are placed between the beams 40 and 37 horizontally. The piece of foam 49 is placed at the junction of beams 40 and 45 ensuring the continuity of the seal horizontally. The joint of foam 50 is inserted in vertical grooves of beams 40 and 45, and each side of the rectangular piece of foam 49 providing waterproofing vertically. The higher beam 37 laid out on the joints and pressing them against the lower beam, makes the seals hermetic.

FIGS. 3.1, 3.2, 3.3 and 3.4 show multiple ways of attaching beams with the thin steel bands.

FIG. 3.1 shows the assembly of beams 55 and 56, at 90 degrees, maintained in place using the pins 57 and the thin steel bands 22, $22^1$. The thin steel bands pass in holes 41 of beam 56 and they are maintained in the center of the holes by the pins which are cut in half 61 and 62. The thin steel bands are put in tension and are fixed by means of a fastener 65.

FIG. 3.2 shows the assembly of beams 36, 37 and 38, which are maintained in place using the thin steel bands 22, which are laid out on iron-angles 80, whose edges are rounded and are put in tension and fixed by means of fastener 65.

FIG. 3.3 shows the assembly of beams 36, 37 and 38 maintained in place using the thin steel bands 22 which are inserted in slits 94, are cut in beams and put in tension and fixed by means of a fastener.

FIG. 3.4 shows the assembly of the beams 36, 37 and 38, maintained in place using the thin steel bands 22 with angle 80, by means of the method showed in FIG. 3.2.

FIGS. 4.1 and 4.2 show the principle of a thin steel band 22 installed on a bearing surface above several superimposed beams allowing the wall to remain straight, throughout the drying of the wooden beams by adjusting the tension of the band. On FIG. 4.1 screws 120 equipped with a slit 121 in order to insert the thin steel band 122 in a flat position 123. The two ends of the thin steel band cross and superimpose themselves through the opening 121. There is no rotation of the bolt 120 and the nut 124 is not tight.

On FIG. 4.2, one sees that bolt 120 is turned counter clockwise rolling the thin steel band 122 around the bolt 120 rolling it in position 125. The thin steel band 122 applies a clockwise couple on the bolt 120. The nut 124 is tightened and the clockwise couple of the band maintains the assembly on a tight state. If the volumetry of the assembly decreases, the same operations are repeated in order to give the tension to the thin steel band.

A device intended to tighten aligned rectangular elements and comprising a first part, comprising means of winch 24 for applying a force, an intermediate part comprising cable means for transmitting the force over a distance and a third part comprising means for maintaining the force. The rectangular elements being beams of a group of materials comprising wood, plastic or concrete and some of them could shrink during drying.

That first part comprising a case having a flat surface for positioning the winch thereon for the application of the force and located within a top part of the beams. The means of winch 24 comprising means for rolling the cable means, and the intermediate part which comprises cable means being tightened to a maximum by means of the winch 24 and by a corresponding ratchet 25.

The intermediate part comprising cable means passing from a higher beam 36, through a passage within intermediate beams and ending in the lower part, around means of steel stem 21 welded onto a lower steel disc 26 which under the effect of tension of the cable compresses a compression spring 30 against an intermediate disc of steel 28 and against the intermediate beam 40. Those cable means comprise a flat band 22 passing within a channel passage 41 through the intermediate beam 40. And the third part being a lower part of the beams.

The compression spring is pressed on the intermediate steel disc 28 which is laid out on an edge 31 which makes the junction between the narrow passage of the band 41 and the broader channel of spring 39, the steel stem 21 welded onto the steel disc 26, under the effect of tension of the band 22 compressing the spring in compression 30 against the steel disc 28 and against the edge 31. The steel stem is also welded onto a lower steel disc 26 and localised at the end of a last lower part and extends inside the spring in compression 30 and located in a channel of spring 39 broader than the channel passage of the band or cable 41.

An edge 31 which makes the junction between the narrow passage of the band 41 and the broader channel of spring 39, the steel stem 21 welded onto the steel disc 26, under the effect of tension of the band 22 compressing the spring in compression 30 against the steel disc 28 and against the edge 31.

The device is installed inside the beams and comprising means of adhesion and sealing of the beams between them. Those means of sealing consisting of compressible seals 44 and 49 applied on bearing surfaces of the beams 40 and 45, and a vertical joint 50 being applied at the junction of the beams 40 and 45. A higher beam 37 being laid out onto the joint and crushing it against a lower beam, making thus the seal hermetic. The bearing surfaces being compressible sheets of foam, soaked on the ends in an elastomer resistant to moisture, bad weather and UV rays.

The band 22 is intended to be used installed on a wall, a floor, or roof and is intended to consolidate the wall, floor, or roof during the drying, by tensioning the band with a tensioner comprising a bolt 120 having a slit 121 and a nut 124, the slit 121 in the bolt 120 engaging the band in a flat position 123 or in a rolled position 125, the tensioner giving a counter clock wise rotation to the band, the nut 124 immobilizing the tensioner.

Initially the thin steel band is tended to its maximum, and when the beam's volume decreases the band is slackened, the pressure applied on the ratchet by the band is slackened and the spring which was maintained in compression by the ratchet starts to expand. The role of the spring is to maintain the force in the assembly at all times and to maintain the integrity of the assembly during the duration of the drying of the wood or the change in volumetry of the assembly. The elements can inflate or deflate, according to the materials used and to some environmental factors such temperature, moisture, etc. The travel of the spring and the compression which is applied on the spring are determined according to the change in volumetry anticipated in the assembly. No adjustment is necessary during the period of wood seasoning. During or at the end of the drying, the adjustments to the tension of the assembly can be made using the winch. By using the winch, we roll manually the band until we obtain the sought tension by compressing the spring. The wood beams decrease in volume considerably after complete drying which occurs approximately a year after construction. After this time, the wood is dry and stable. The spring used in the compresses approximately 4 inches, it is thus able to ensure a sufficient pressure to maintain the beams tightened during the period of drying. Very little maintenance is necessary until the end of drying. The metal bands without winch nor spring are also used for purposes of construction for an assembly having a limited number of beams.

It is to be clearly understood that the instant description with reference to the annexed drawing is made in an indicative manner and that the preferred embodiments described herein are meant in no way to limit further embodiments realizable within the scope of the invention. The matter which is claimed as being inventive and new is limited only by the following claims.

PARTS

| | |
|---|---|
| 20 | Device |
| 21 | Steel stem |
| 22 | Thin steel band |
| 24 | Winch |
| 25 | Ratchet |
| 26 | Lower steel disc |
| 28 | Steel disc |
| 30 | Spring |
| 34 | Hole of the winch |
| 36 | Higher beam |
| 37 | Beam under the higher beam |
| 38 | Lower beam |
| 40 | Intermediate beam |
| 41 | Hole for the band |
| 44 | Compressible seal |
| 46 | Surface d'appui |
| 48 | Embout caoutchouté |
| 49 | Central horizontal compressible seal |
| 50 | Vertical seal |
| 55 | Vertical beam |
| 56 | Horizontal beam |
| 57 | Pin |

-continued

| | |
|---|---|
| 61 | Pin into half-round left |
| 62 | Pin into half-round right |
| 65 | Fastener |
| 80 | Steel iron-angle |
| 94 | Slit in a beam |
| 120 | bolt |
| 121 | Slit in a screw |
| 123 | Flat position |
| 124 | nut |
| 125 | Rolled position |
| 31 | Edge |
| 39 | Channel of spring |

I claim:

1. A device for tightening aligned rectangular elements comprising:

a first part comprising a winch (24) for applying a force, an intermediate part comprising cable means for transmitting said force over a distance, and a third part comprising means for maintaining said force, said first part comprising a case having a flat surface for positioning said winch thereon for the application of said force, said winch (24) comprising means for rolling said cable means, said rectangular elements being upper, lower, and intermediate beams selected from the group consisting of wood, plastic, and concrete, said first part being located within an upper one of said beams;

said third part being in a lower one of said beams, said cable means tightened to a maximum by said winch (24) and by a corresponding ratchet (25), said cable means passing through a passage having a first and a second portion from the upper beam (36), through the intermediate beams, and ending in said lower beam, around means of a steel stem (21) welded onto a lower steel disc (26) which under the effect of tension of said cable compresses a compression spring (30) against an intermediate disc of steel (28) and against one of said intermediate beams (40).

2. The device of claim 1 wherein said cable means comprise a flat thin steel band (22) passing within said passage (41) through said intermediate beams (40).

3. The device of claim 2 wherein said steel stem (21) is welded onto said lower steel disc (26) and localized at the end of a lower part of said lower steel disc (26) said steel stem extends adjacent said compression spring and wherein said compression spring is located in the second portion of said passage, said second portion having a diameter larger than a diameter of said first portion of said passage (41).

4. The device of claim 3 wherein said spring presses on said intermediate steel disc (28) compressing it against an edge of said one of said intermediate beams, the intermediate steel disc is at a junction between the first portion and the second portion of the passage.

5. The device of claim 3 installed inside said beams and comprising means of adhesion and sealing of said beams between them, said means of sealing comprising a compressible seal (44)(49) applied on bearing surfaces of said beams (40, 45) and in a vertical joint (50) at the junction of said beams (40,45), the upper beam (37) being laid out onto said joint and crushing it against lower beam, making a hermetic seal, said bearing surfaces being compressible sheets of foam, soaked on the ends in an elastomer resistant to moisture, bad weather and UV rays.

6. The device of claim 2, further comprising a tensioner, wherein said thin steel band (22) is adapted to be used installed on a wall, a floor, or a roof and intended to allow said wall, floor, or roof to remain consolidated during a time of drying by applying tension within said band, said tension being applied by said tensioner, said tensioner comprising a bolt (120) having a slit (121) in said bolt (120), and a nut 124, the tensioner giving a counter clockwise rotation of the thin steel band, and the nut (124) immobilizes the tensioner when the nut (124) is tightened.

7. The device of claim 1 wherein said cable means is a cable.

* * * * *